US007504912B2

(12) United States Patent
Aigle et al.

(10) Patent No.: US 7,504,912 B2
(45) Date of Patent: Mar. 17, 2009

(54) BASIC BODY FOR A YIG FILTER WITH EDDY CURRENT SUPPRESSION

(75) Inventors: Michael Aigle, Sauerlach (DE); Claus Tremmel, Haar (DE)

(73) Assignee: Rohde & Schwarz GmbH & Co. KG, München (DE)

( * ) Notice: Subject to any disclaimer, the term of this patent is extended or adjusted under 35 U.S.C. 154(b) by 46 days.

(21) Appl. No.: 11/667,972

(22) PCT Filed: Nov. 3, 2005

(86) PCT No.: PCT/EP2005/011779

§ 371 (c)(1),
(2), (4) Date: Sep. 27, 2007

(87) PCT Pub. No.: WO2006/056303

PCT Pub. Date: Jun. 1, 2006

(65) Prior Publication Data

US 2008/0048805 A1 Feb. 28, 2008

(30) Foreign Application Priority Data

Nov. 22, 2004 (DE) ..... 10 2004 056 256

(51) Int. Cl.
*H01P 1/218* (2006.01)

(52) U.S. Cl. ..... 333/202; 333/219.2

(58) Field of Classification Search ..... 333/202, 333/219.2, 219

See application file for complete search history.

(56) References Cited

U.S. PATENT DOCUMENTS

| | | | | |
|---|---|---|---|---|
| 4,794,355 | A | 12/1988 | Harris | |
| 4,857,871 | A | 8/1989 | Harris | |
| 5,294,899 | A | 3/1994 | Tanbakuchi | |
| 5,418,507 | A * | 5/1995 | Keane et al. | 333/202 |
| 5,714,920 | A | 2/1998 | Ivanov et al. | |

FOREIGN PATENT DOCUMENTS

| | | |
|---|---|---|
| DE | 39 33 157 C2 | 2/1993 |
| DE | 693 31 919 T2 | 6/1999 |
| EP | 0 285 326 A3 | 10/1988 |

OTHER PUBLICATIONS

International Search Report for counterpart international application PCT/EP2005/01177; Date of Mailing Jan. 30, 2006.

International Preliminary Report on Patentability for counterpart international application PCT/EP2005/011779, including claims annex (English and German Language); completion date: Feb. 1, 2007.

* cited by examiner

*Primary Examiner*—Stephen E Jones
(74) *Attorney, Agent, or Firm*—Marshall, Gerstein & Borun LLP

(57) ABSTRACT

A base body for a YIG bandpass filter configured from a non-magnetic metal and including filter chambers, which are configured in the base body and contain YIG elements. Cavities and/or radial slots are configured in the base body for the suppression of eddy currents.

8 Claims, 1 Drawing Sheet

BASIC BODY FOR A YIG FILTER WITH EDDY CURRENT SUPPRESSION

The invention relates to a basic body for a YIG band-pass filter.

YIG band-pass filters have at least one YIG element which preferably has a spherical configuration and is produced from an yttrium-iron-garnet (YIG). The resonator effect is provided by coupling lines.

A tunable YIG band-pass filter is known for example from U.S. Pat. No. 5,294,899. The tunable YIG band-pass filter has a stationary magnetic pole, a rotatable magnetic pole which has a spacing therefrom, an electromagnet for changing the magnetic field between the poles and a plurality of resonators (YIG elements) which are mutually coupled and disposed in the magnetic field between the poles. The number of ferrimagnetic resonators is three or more with respectively one input and output resonator and at least one resonator which is situated therebetween. The rotatable magnetic pole is rotated such that the resonators are tuned to the same resonance frequency by the magnetic field between the two magnetic poles.

It is particularly disadvantageous in the YIG band-pass filter known from the above-mentioned patent that eddy currents which delimit the tuning speed are induced in the one-piece basic body of the YIG band-pass filter due to the rapid detuning of the frequency-determining magnetic field which is required for example for spectrum analyzers.

SUMMARY OF THE INVENTION

The invention accordingly provides a basic body for a YIG filter which reduces the induction of the eddy currents which are induced in the basic body by the tuning.

According to the invention, a basic body for YIG band-pass filter comprises a non-magnetic metal and filter chambers connected thereto in the basic body, YIG elements disposed in the filter chambers, outer recesses and/or radial slots for suppressing an eddy current in the basic body, and at least one inner recess, which is not connected to filter chambers disposed completely between the filter chambers.

BRIEF DESCRIPTION OF THE DRAWING

A preferred embodiment of the invention is illustrated by way of example subsequently and described in more detail in the subsequent description.

DETAILED DESCRIPTION

Figure 1:
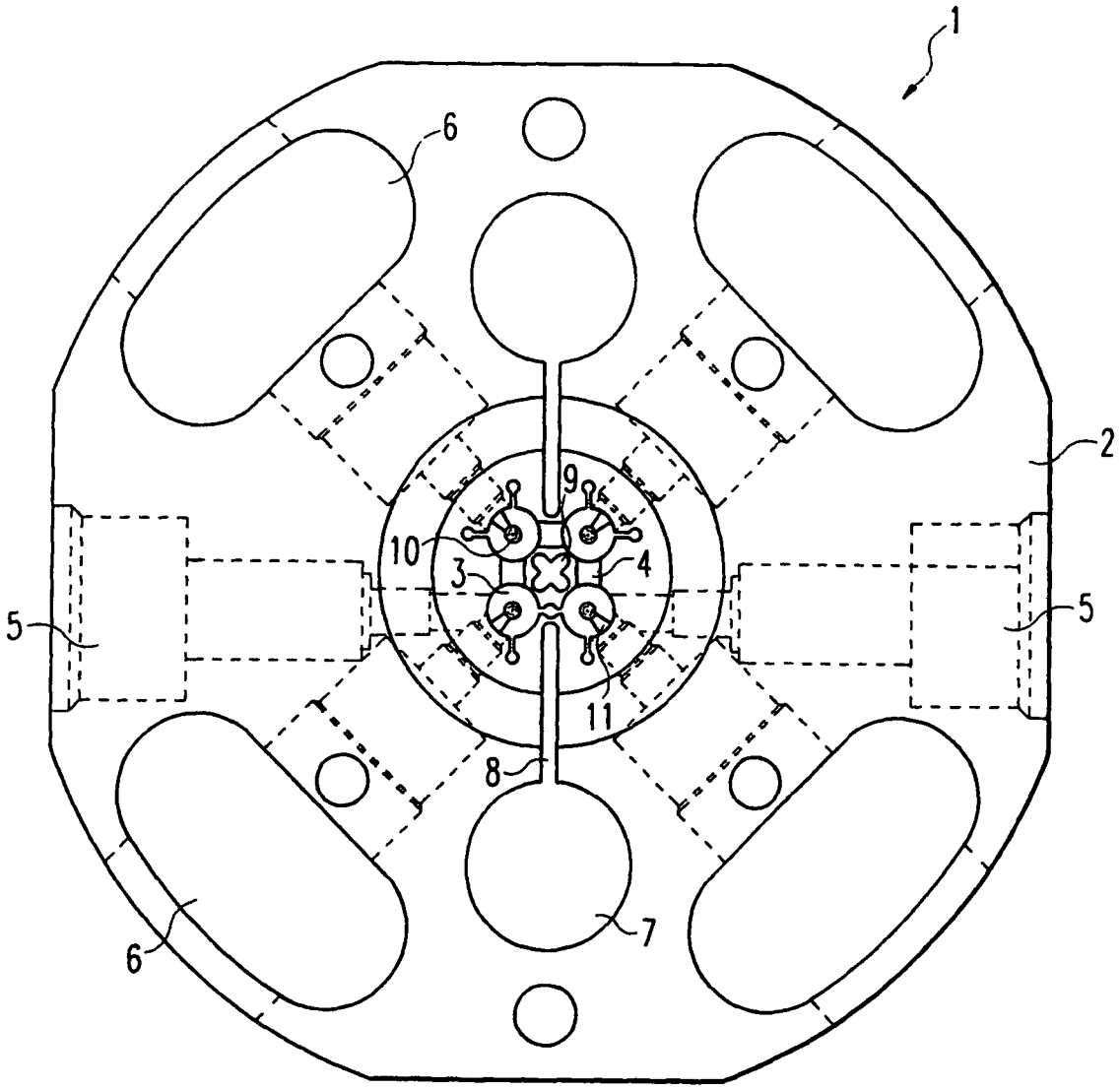
FIG. 1 shows a schematic plan view of an embodiment of a basic body configured according to the invention of a YIG band-pass filter.

FIG. 1 shows in a schematic plan view an embodiment of a YIG band-pass filter 1, which has a basic body 2 and, in the embodiment, four filter chambers 3 which are configured in the basic body 2 and have the same number of YIG elements 10.

The filter chambers 3 are connected to each other by means of slots 4, in which coupling lines, which are not further represented for reasons of clarity, are inserted and provide the resonator effect between the resonators 10. The number of filter chambers 3 is thereby not restricted to four, but can also be fewer or more.

The YIG band-pass filter 1 includes further components which are independent of the measures according to the invention and hence are only illustrated as an overview. One coupling and decoupling line 5 respectively are situated opposite each other in the basic body 2 in the embodiment. Adjustment devices 6 for the YIG elements 10, which make possible correct positioning of the four YIG elements 10 in this embodiment relative to the coupling lines, are present in the corresponding number. The YIG elements 10 are mounted on retainers 11 which can be adjusted in their position relative to the not-represented coupling lines by means of the adjustment devices 6.

The filter effect of a YIG band-pass filter 1 is based on coupling of the resonators 10 which, during resonance, make it possible to convey energy from the coupling line to the decoupling line, however preventing this outside the resonance. The operating frequency of the YIG band-pass filter 1 is substantially determined by the strength of the applied magnetic field.

In order to provide the magnetic field, the YIG elements 10 are situated in the basic body 2 in an airgap of an electromagnet. The basic body 2 thereby is made of a solid non-magnetic metal. This has the advantage of simple mechanical machinability, however, as already mentioned above, the disadvantage that eddy currents can be induced. Furthermore, the metallic basic body 2 serves for the purposes of coupling the individual YIG filter stages by means of as far as possible closed conductive surfaces.

The eddy currents produce a magnetic field which is directed counter to the original magnetic field and hence delimit the tuning speed. Eddy currents in the region of the filter chambers 3 are thereby particularly relevant, since these directly interfere with the frequency-determining field at the location of the YIG elements 10.

In order to eliminate the disadvantages, the basic body 2 according to the invention has recesses 7 and slots 8 connected thereto which serve for suppressing the eddy currents which are induced in the basic body 2 by the rapid tuning of the YIG band-pass filter 1.

The outer recesses 7 are disposed radially outside the filter chambers 3. The slots 8 extend radially outwardly between the filter chambers 3. The recesses 7 have a cross-section which is round, rounded-off or has an oblong hole shape. The outer recesses 7 and the slots 8 connected thereto are configured in the basic body 2 such that an interruption of the eddy currents, in particular in close proximity to the YIG elements 10, is possible. For this purpose, at least one slot 8, in the embodiment two slots 8, is introduced radially from the inside to the outside in the basic body 2, so that an interruption of the closed basic body 2 and hence of the eddy currents is effected in a radially outer region about the YIG elements 10. The outer recesses 7 and the slots 8 intersect in an inner region. Between the filter chambers 3, a further inner recess 9, which has a cross-shaped configuration in the embodiment, is provided, in order to reduce the eddy currents in the radially inner region of the basic body 2.

The outer recesses 7 and the inner recesses 9 and the slots 8 in the basic body 2 are thereby introduced in the complete axial extension thereof, in order to make possible good suppression of the eddy current.

According to the number of filter chambers 3 and the arrangement of the remaining components, basic bodies 2 having a slot 8 or basic bodies 2 having a plurality of slots 8 are possible. Heed merely needs to be paid to the mechanical stability of the basic body 2 for assembly of the individual components.

The invention is not restricted to the represented embodiment and is suitable for any arbitrarily configured YIG band-pass filter 1. The individual features can thereby be combined together in any manner.

The invention claimed is:

1. Basic body for a YIG band-pass filter, the basic body comprising a non-magnetic metal and filter chambers connected thereto in the basic body, YIG elements disposed in the filter chambers, outer recesses and/or radial slots for suppressing an eddy current configured in the basic body, and at least one inner recess, which is not connected to filter chambers, disposed completely between the filter chambers.

2. Basic body according to claim 1, wherein the recesses and/or the slots extend across an entire axial thickness of the basic body.

3. Basic body according to claim 1, wherein the slots extend radially outwardly between the filter chambers.

4. Basic body according to claim 1, wherein the number of outer recesses and/or of slots is two.

5. Basic body claim 1, wherein the outer recesses have a cross-section which is round, rounded-off or has an oblong hole shape.

6. Basic body according to claim 1, wherein the inner recess has a cross-shaped configuration.

7. Basic body according to claim 1, wherein at least one outer recess is disposed radially outside the filter chambers.

8. Basic body according to claim 7, wherein the outer recesses are disposed on the slots.

* * * * *